US006454991B1

(12) United States Patent
Yoshimura et al.

(10) Patent No.: US 6,454,991 B1
(45) Date of Patent: Sep. 24, 2002

(54) METHOD OF FORGING RAW MATERIAL FOR SINTERING AND FORGING

(75) Inventors: Takashi Yoshimura; Mitsumasa Iijima; Shin Koizumi; Yasuo Hatai, all of Kanagawa (JP)

(73) Assignee: Unisa Jecs Corporation, Atsugi (JP)

( * ) Notice: Subject to any disclaimer, the term of this patent is extended or adjusted under 35 U.S.C. 154(b) by 0 days.

(21) Appl. No.: 09/984,300

(22) Filed: Oct. 29, 2001

(30) Foreign Application Priority Data

Oct. 30, 2000 (JP) ..... 2000-330105

(51) Int. Cl.[7] ..... B22F 3/20
(52) U.S. Cl. ..... 419/28; 419/41
(58) Field of Search ..... 419/28, 41

(56) References Cited

U.S. PATENT DOCUMENTS 3,293,006 A * 12/1966 Bartz ..... 29/182
3,785,038 A * 1/1974 Zapf ..... 29/420.5
3,837,068 A * 9/1974 Dunn ..... 29/420.5
4,587,707 A * 5/1986 Nishida et al. ..... 29/527.7
4,774,749 A * 10/1988 Furumura ..... 29/149.5 NM
5,006,289 A * 4/1991 Yamamoto et al. ..... 264/61
5,053,192 A * 10/1991 Merzhanov et al. ..... 419/10
5,069,866 A * 12/1991 Ekbom ..... 419/6
5,547,632 A * 8/1996 Horimura et al. ..... 419/28
6,323,623 B1 * 11/2001 Someya et al. ..... 320/166

FOREIGN PATENT DOCUMENTS

JP 2000-17307 1/2000

OTHER PUBLICATIONS

"Industrial Library 13—High Speed Forging," Nikkan Kogyou Shinbunsha, pp. 38–39 (Jun. 25, 1969).

* cited by examiner

*Primary Examiner*—Daniel J. Jenkins
(74) *Attorney, Agent, or Firm*—Foley & Lardner

(57) ABSTRACT

A method of forging a raw material for sintering and forging. The method comprises the steps of: (a) compacting metallic powder containing iron as a main component and graphite to obtain a compact having a predetermined density; (b) sintering the compact at a temperature ranging from 700 to 1000° C. to form a sintered compact having a texture in which graphite is retained at grain boundary of metal powder; (c) compressing the sintered compact from two directions to obtain a compressed sintered compact; and (d) extruding the compressed sintered compact upon pressing the compressed sintered compact from the two directions in a manner that a pressure in one of the two directions is reduced relative to a pressure in the other of the two directions to accomplish extrusion forging.

20 Claims, 9 Drawing Sheets

| | ELONGATION PERCENTAGE (%) | | | |
|---|---|---|---|---|
| SINTERING TEMP. (°C) | 0.1%C | 0.3%C | 0.5%C | 1.0%C |
| 600 | 1.7% | 1.4% | 1.5% | 1.2% |
| 700 | 2.3% | 1.8% | 1.7% | 1.4% |
| 800 | 3.6% | 3.3% | 2.9% | 2.8% |
| 900 | 5.9% | 5.7% | 5.4% | 5.1% |
| 1000 | 7.8% | 7.0% | 6.7% | 6.2% |
| 1100 | 3.1% | 2.9% | 2.2% | 1.6% |

| | ELONGATION PERCENTAGE (%) | | | |
|---|---|---|---|---|
| SINTERING TEMP. (°C) | 0.1%C | 0.3%C | 0.5%C | 1.0%C |
| 600 | 44.3 | 45.7 | 46.1 | 45.8 |
| 700 | 46.2 | 46.5 | 45.8 | 47.1 |
| 800 | 47.4 | 48.6 | 50.0 | 53.3 |
| 900 | 53.5 | 55.1 | 57.1 | 59.4 |
| 1000 | 64.4 | 65.9 | 67.5 | 70.2 |
| 1100 | 73.8 | 73.4 | 76.3 | 78.3 |

| | ELONGATION PERCENTAGE (%) | | | |
|---|---|---|---|---|
| SINTERING TEMP. (°C) | 0.1%C | 0.3%C | 0.5%C | 1.0%C |
| 700 | 2027 | 2046 | 2068 | 2119 |
| 800 | 2293 | 2333 | 2390 | 2405 |
| 900 | 2430 | 2596 | 2543 | 2591 |
| 1000 | 2685 | 2762 | 2837 | 2944 |

FIG.9

| ITEM | COMPOSITION | AMOUNT OF GRAPHITE | SINTERING CONDITION | | | SINTERED COMPACT | | FORMING LOAD (MPa) | FORGEABILITY | | |
|---|---|---|---|---|---|---|---|---|---|---|---|
| | | | TEMP.×TIME | ATOM. | DENSITY (g/cm³) | ELONGATION PERCENTAGE | HARDNESS | | REARWARD EXTRUSION | FORWARD EXTRUSION | TWO-DIRECTION PRESSING |
| EXAMPLE 1 | 1.0Cr-0.3Mo-0.7Mn | 0.3% | 800°C×60min. | $N_2$ | 7.4 | 3.3% | 48.6 | 2333 | G | NG | G |
| EXAMPLE 2 | 1.0Cr-0.3Mo-0.7Mn | 0.3% | 900°C×60min. | $N_2$ | 7.4 | 5.7% | 55.1 | 2596 | G | NG | G |
| COMPARATIVE EXAMPLE | 1.0Cr-0.5Mo-0.7Mn | 0.5% | 1250°C×60min. | $N_2$ | 7.1 | 2.6% | 75.0 | FORMING IMPOSSIBLE | NG | NG | NG |

FIG.10

| ITEM | DIMENSION OF DIE (mm) | DIMENSIONAL ACCURACY OF FORGING | | | |
|---|---|---|---|---|---|
| | | | OUTER DIAMETER | INNER DIAMETER | DRAFT |
| CONVENTIONAL FORGING METHOD (HOT FORGING) | OUTER DIAMETER: 30.05 INNER DIAMETER: 23.25 | MAX. | 30.5mm | 23.75mm | 1～5° |
| | | MIN. | 29.5mm | 22.75mm | |
| | | DISPERSION | 1.0mm | 1.0mm | |
| FORGING METHOD OF PRESENT INVENTION | | MAX. | 30.070mm | 23.295mm | 0° |
| | | MIN. | 30.040mm | 23.235mm | |
| | | DISPERSION | 0.03mm | 0.06mm | |

METHOD OF FORGING RAW MATERIAL FOR SINTERING AND FORGING

BACKGROUND OF THE INVENTION

This invention relates to improvements in a method of forging a raw material for sintering and forging in order to produce a forging to be used as a mechanical part or the like, and more particularly to the method of forging a sintered compact containing iron as a main component and graphite.

Hitherto forging has been widely used for producing mechanical parts. Additionally, in recent years, it has been studied to produce a mechanical part first by sintering compacted metallic powder to form a sintered compact and then by forging the sintered compact. The metallic powder contains iron as a main component and further contains a certain amount of graphite. It has been known that crack tends to be readily produced in a product by making extrusion forging on such a sintered compact.

This fact is described, for example, at pages 38 and 39 of a technical text "Industrial Library 13—High Speed Forging (published on Jun. 25, 1969 by Nikkan Kogyou Shinbunsha)". According to this technical text, iron powder is subjected to pre-compacting and sintering thereby to form a sintered compact having a relative density of 78%, and then the sintered compact undergoes extrusion forging under pressing upon loading a back pressure of 4000 kg/cm$^2$. This technical text recites that production of crack cannot be prevented. Additionally, the technical text recites that production of crack can be prevented in case that the above sintered compact is subjected to extrusion forging with a high speed hammer loading a back pressure of 3000 kg/cm$^2$.

In the latter forging method, production of crack can be prevented; however, a forming speed during the forging is high to generate heat thereby inviting another disadvantage that such heat causes the dimensional accuracy of a forging to lower.

Apart from the above, in recent years, a forging method as disclosed in Japanese Patent Provisional Publication No. 2000-17307 has been devised and proposed. This forging method is summarized as follows: Metallic powder is compacted to form a compact having a certain density. Thereafter, the compact is sintered at 1300° C. under vacuum thereby forming a sintered compact. The sintered compact is located in a die and pressurized from upward and downward directions under heating, in which a pressure from the downward direction is reduced relative to that from the upward direction thereby accomplishing extrusion forging. According to this forging method, production of crack in a forging can be prevented under the effects of heating during the extension forging and application of the pressures from upward and downward directions.

However, drawbacks have been encountered in such a conventional forging method. Specifically, in case that metallic powder as a raw material is prepared by mixing graphite with metal powder containing iron as a main component, graphite is excessively diffused in the metal powder to largely increase the hardness of the sintered compact. Accordingly, if sufficient heat is not applied to the sintered compact during the succeeding extrusion forging, production of crack will occur in the resultant forging. Thus, in the conventional forging method, carrying out such high temperature heating is required during the extrusion forging, thereby large-sizing and complicating a facility or forging machine upon addition of a heating device while shortening the life of the die and lowering the dimensional accuracy of the resultant forging.

SUMMARY OF THE INVENTION

In view of the above, it is an object of the present invention to provide an improved method of forging a raw material for sintering and forging, which can effectively overcome drawbacks encountered in conventional forging methods.

Another object of the present invention is to provide an improved method of forging a raw material for sintering and forging, which can securely prevent production of defects such as crack and the like of a resultant forging without inviting large-sizing and complication of a forging facility or machine, shortening the life of a die and lowering the dimensional accuracy of the resultant forging.

An aspect of the present invention resides in a method of forging a raw material for sintering and forging. The method comprises the steps of: (a) compacting metallic powder containing iron as a main component and graphite to obtain a compact having a predetermined density; (b) sintering the compact at a temperature ranging from 700 to 1000° C. to form a sintered compact having a texture in which graphite is retained at grain boundary of metal powder; (c) compressing the sintered compact from two directions to obtain a compressed sintered compact; and (d) extruding the compressed sintered compact upon pressing the compressed sintered compact from the two directions in a manner that a pressure in one of the two directions is reduced relative to a pressure in the other of the two directions to accomplish extrusion forging. Preferably, metallic powder contains at least one selected from the group consisting of as chromium, molybdenum, manganese, nickel, copper, tungsten, vanadium and cobalt.

Another aspect of the present invention resides in a method of forging a raw material for sintering and forging. The method comprises the steps of: (a) compacting metallic powder containing iron as a main component and graphite to obtain a compact; (b) sintering the compact at a temperature ranging from 700 to 1000° C. to form a sintered compact having a texture in which graphite is retained at grain boundary of metal powder; (c) filling the compact in a forming space of a die; (d) compressing the sintered compact in the forming space of the die from opposite directions without heating to obtain a compressed sintered compact; and (e) extruding the compressed sintered compact in the die without heating by controlling pressures in the opposite directions in a manner that the pressure in one of the opposite directions is decreased relative to the pressure in the other of the opposite directions to accomplish extrusion forging.

According to the present invention, in the sintered compact obtained by sintering the compact at 700 to 1000° C., binding among metals progresses in such a manner as to be able to make a compression deformation while graphite is hardly diffused and is dispersed at grain boundary. When this sintered compact is compressed from two directions, it can be easily compression-deformed under cold compression thereby forming the high density compressed sintered compact. Then, this compressed sintered compact is compressed from the two directions, in which the pressure from one direction is reduced relative to that from the other direction. As a result, the compressed sintered compact is cold-extruded from the side of the other direction thereby obtaining a forging having no defects such as crack and the like.

Preferably, the predetermined density of the compact is not lower than 7.1 g/cm$^3$. With this feature, metal powder is in a condition where contact among metal particles of the metal powder is increased. Additionally, the composition of the sintered compact is in a condition where graphite is retained at grain boundary of the metal powder while precipitates such as carbide and the like are hardly formed. As a result, the sintered compact is high in hardness and high in elongation percentage while lubricating characteristics at grain boundary of metal powder is increased thereby to wholly raise the deformability of the sintered compact. These effects are combined with the above effects of the particular forging process thereby making it possible to prevent production of defects such as crack and the like.

Preferably, the compressing step and the extruding step are successively carried out. With this feature, the sintered compact which has been subjected to a forming process at the compression step can be transferred to the succeeding extruding step without its work hardening. Accordingly, extrusion forging can be made without trouble even a raw material which tends to readily make its work hardening.

Preferably, the compressing step and the extruding step are carried out without heating the sintered compact. With this feature, the dimensional accuracy of the resultant forging can be raised while thermal deterioration of a die can be prevented.

Preferably, the sintered compact is extruded under a forward extrusion in the extruding step. With this feature, forging of a long member can be realized without inviting crack or the like of the long member.

Preferably, the step of preparing a die which has a compression section formed with a first space in which the sintered compact is set to be compressed, and an extrusion section continuous with the compression section and formed with a second space continuous with the first space of the compression section. The second space is smaller in sectional area than the first space. Here, the compression step is carried out by the compression section to increase a density of the sintered compact to form a compressed sintered compact which is to be extruded into the extrusion section, and the extruding step is carried out by the extrusion section successively to the compression step to form a forging. With this feature, the compression section and the extrusion section are formed continuous in the die, so that the compression step and the extrusion step are successively carried out.

Preferably, the first space of the compression section of the die is shaped corresponding to a final product or resultant forging. With this feature, a further processing is unnecessary onto a part of the material remaining in a not-extruded state in the compression section of the die, and therefore the material in the compression section can be used as a product as it is.

The other objects and features of this invention will become understood from the following description with reference to the accompanying drawings.

BRIEF DESCRIPTION OF THE DRAWINGS

FIG. 9 is a table containing experimental data representing the experimental conditions and results of Examples 1 and 2 and Comparative Example;

FIG. 10 is a table containing experimental data of the dimensional accuracy of forgings which are produced respectively by a conventional forging method and the forging method according to the present invention;

DETAILED DESCRIPTION OF THE INVENTION

Figure 1:
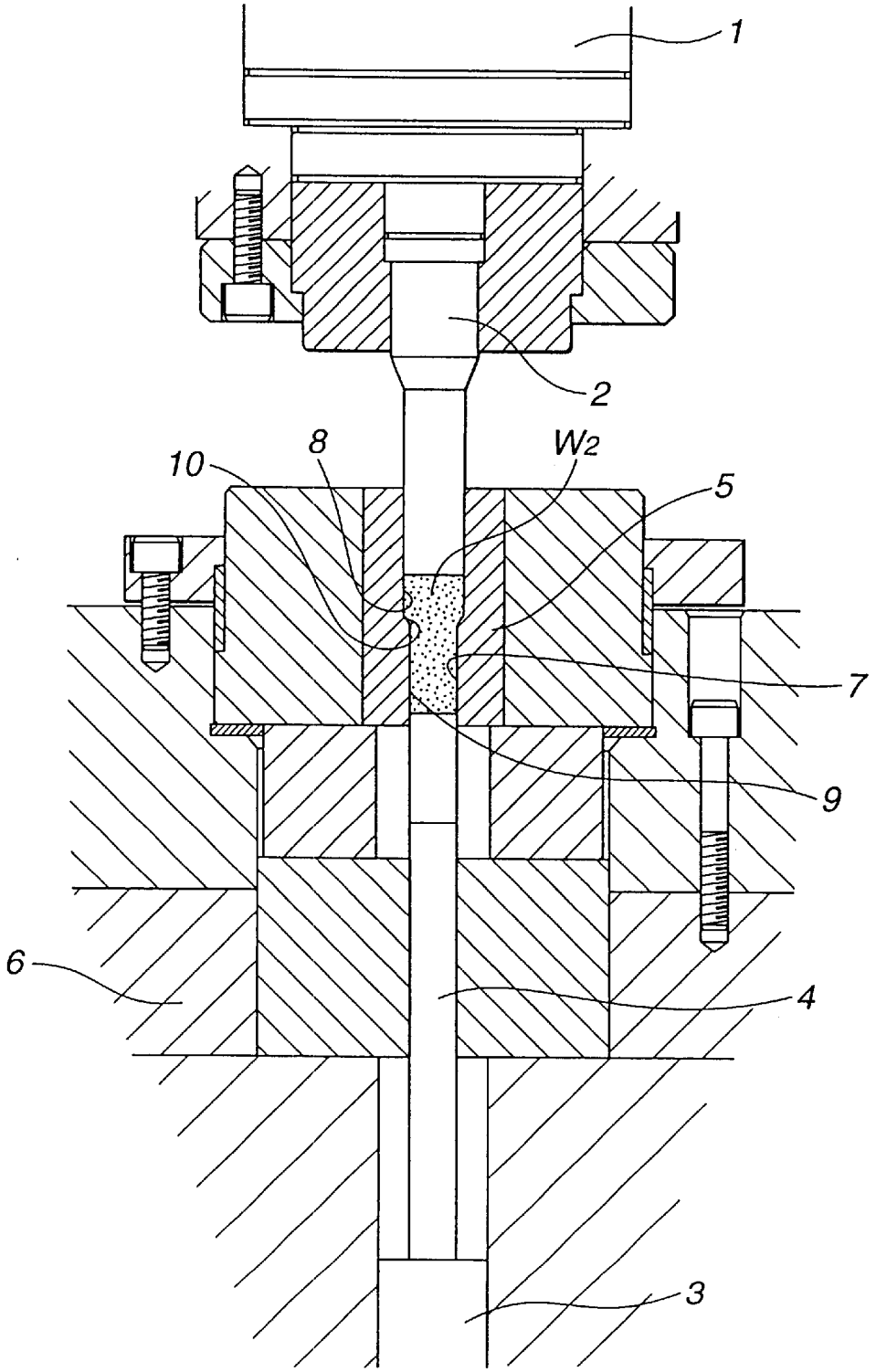
FIG. 1 is a vertical sectional view of an essential part of an example of a forging machine carrying out a forging method according to the present invention.

According to the present invention, a method of forging a raw material for sintering and forging comprises the steps of: (a) compacting metallic powder (the raw material) containing iron as a main component and graphite to obtain a compact having a predetermined density; (b) sintering the compact at a temperature ranging from 700 to 1000° C. to form a sintered compact having a texture in which graphite is retained at grain boundary of metal powder; (c) compressing the sintered compact from two directions to obtain a compressed sintered compact; and (d) extruding the compressed sintered compact upon pressing the compressed sintered compact from the two directions in a manner that a pressure in one of the two directions is reduced relative to a pressure in the other of the two directions to accomplish extrusion forging. The above metallic powder preferably contains at least one of hardening alloy elements such as chromium (Cr), molybdenum (Mo), manganese (Mn), nickel (Ni), copper (Cu), tungsten (W), vanadium (V), cobalt (Co) and the like.

An example of a forging machine for carrying out the forging method according to the present invention will be discussed with reference to FIGS. 1 and 2A to 2C.

The forging machine includes an upper ram 1 to which an upper punch 2 is installed. A lower ram 3 is provided coaxially with upper ram 1. A lower punch 4 having a diameter smaller than that of upper punch 2 is installed to lower ram 3. A generally cylindrical forging die 5 is fixedly installed to a stationary base 6. A sintered compact $W_0$ is filled in a forming space 7 formed inside die 5 so as to be subjected to a forming process. The generally cylindrical inner surface (defining forming space 7) of die 5 has a cylindrical large diameter section 8 and a cylindrical small diameter section 9. A generally frustoconical or tapered section 10 is formed between large and small diameter sections 8, 9 in such a manner as to smoothly connect the lower end of large diameter section 8 and the upper end of small diameter section 9. Upper punch 2 is inserted into large diameter section 8, whereas lower punch 4 is inserted into small diameter section 9.

Upper ram 2 and lower ram 3 are operated to independently move upward and downward. In lower ram 3, load to be applied through lower punch 4 to sintered compact $W_0$ or a compressed sintered compact $W_1$ is suitably controllable. In this example, large diameter section 8 and tapered section 10 serve as a compressing section for compressing the sintered compact or the compressed sintered compact, while small diameter section 9 serves as an extruding section for extruding the sintered compact or the compressed sintered compact.

The forging machine of this example is configured to produce a pinion shaft (final product) as a forging, used in an automotive vehicle or the like. The pinion shaft includes a large diameter section installed to a driving section of the vehicle, a small diameter section to which a pinion is fixed, and a frustoconical or tapered section connecting the large and small diameter section, though not shown. The large diameter section, the small diameter section and the tapered section of this pinion shaft correspond respectively to large diameter section 8, small diameter section 9 and tapered section 10 of the inner surface of die 5. In other words, during the extruding step, a material (or the sintered compact) is extruded in a direction of from large diameter section 8 through tapered section 10 to small diameter section 9 of the inner surface (defining forming space 7) of die 5, in which the shape of the inner surface defining the forming space 7 is set such that a part of the material extruded into small diameter section 9 becomes the small diameter section of the pinion shaft while a part of the material remaining in a not-extruded state in large diameter and tapered sections 8, 10 becomes the large diameter and tapered sections of the pinion shaft as it is.

In the step of compacting the metallic powder, a pressure to be impressed on the metallic powder is controlled to obtain the compact having a density of not lower than 7.1 g/cm$^3$, preferably not lower than 7.3 g/cm$^3$. This is because compacting the metallic powder to form the compact having such a high density as not lower than 7.1 g/cm$^3$ increases the contacting area among particles of the metal powder thereby raising the toughness of a resultant product or forging. In case that the density of the compact is not lower than 7.3 g/cm$^3$, voids among the metal particles become independent from each other so that atmospheric gas in a furnace is difficult to enter the inside of the compact, and therefore graphite tends to be readily retained at the grain boundary without being diffused in the subsequent step of sintering. This raises the hardness of sintered compact $W_0$ and effectively suppresses the progress of carburizing causing a reduction in elongation percentage of the resultant product, which is a further effect to be expected. Additionally, since the compact has been formed to have the high density as discussed above, sintering due to a surface diffusion or melting at the contacting surface among particles of the metal powder is made throughout a wide range during the sintering step. Under the effect of such sintering, sintered compact $W_0$ can obtain a large elongation percentage.

Figure 2C:
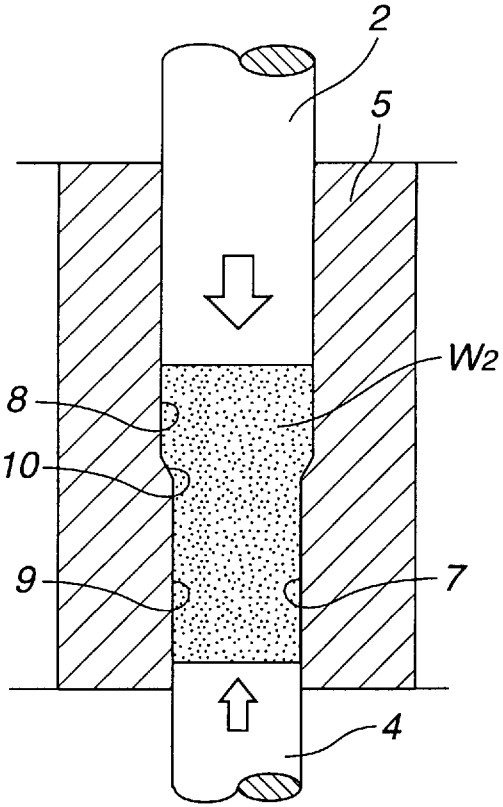
FIG. 2C is a fragmentary sectional view of a third step in the forging method carried out by the forging machine of FIG. 1, succeeding to the second step of FIG. 2B.
Figure 2B:
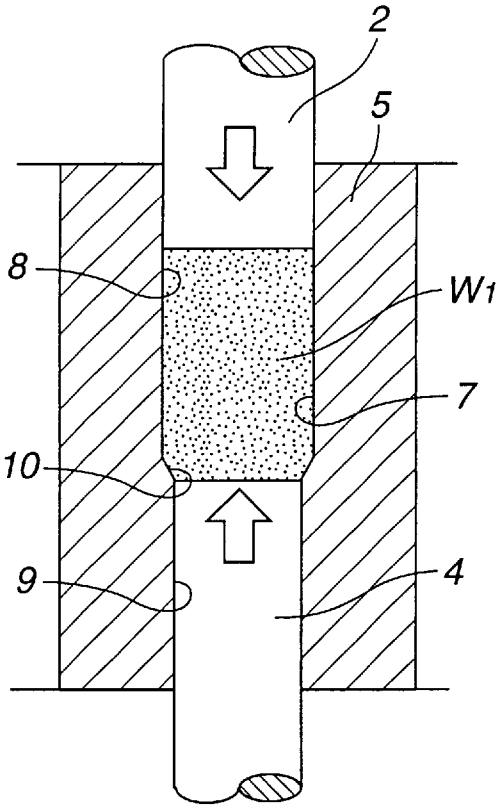
FIG. 2B is a fragmentary sectional view of a second step in the forging method carried out by the forging machine of FIG. 1, succeeding to the first step of FIG. 2A.
Figure 2A:
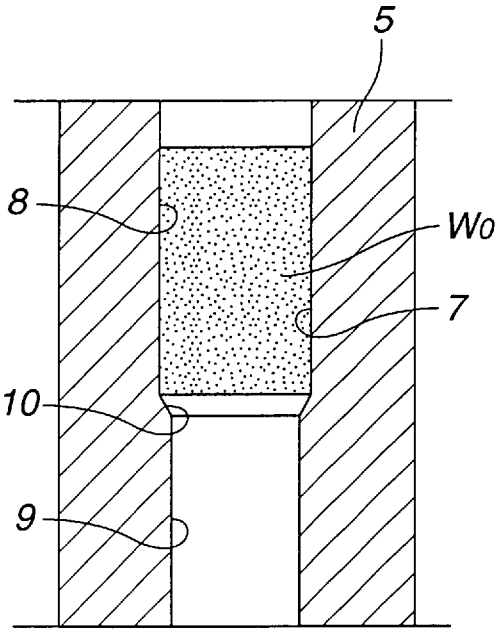
FIG. 2A is a fragmentary sectional view of a first step in the forging method carried out by the forging machine of FIG. 1.

The temperature of sintering the compact is set in the range of from 700 to 1000° C. This is because joining of particles of the metal powder by the sintering cannot progress at the temperature lower than 700 ° C. whereas graphite is excessively diffused to obtain a too high hardness at the temperature exceeding 1000° C. Accordingly, by virtue of the fact that the sintering temperature is set in the above range, particles of the metal powder can be securely joined to each other while graphite can be hardly diffused to remain at the grain boundary. By this, the sintered compact becomes low in hardness and high in elongation percentage while being raised in deformability by large diameter section 8 of the inner surface of the die 5 as shown in FIG. 2A. In this state, lower punch 4 is upwardly moved to a certain level under operation of the lower ram 3, while the upper punch 2 is downwardly moved under operation of the upper ram 1. Thus, the sintered compact $W_0$ is compressed by the upper punch 2 and the lower punch for a certain time and at a certain load thereby densifying the texture of the sintered compact thereby forming a compressed sintered compact $W_1$ (this corresponds to the compressing step). This compressed sintered compact $W_1$ preferably has a density of 7.3 g/cm$^3$ (corresponding to a relative density of 93%), more preferably a density of 7.6 g/cm$^3$ (corresponding to a relative density of 97%).

Subsequently, the load applied to the lower punch 4 is reduced relative to that applied to upper punch 2, in which compressed sintered compact $W_1$ is gradually pushed or extruded out into small diameter section 9 of the inner surface of die 5 while a certain compressive force is being applied to compressed sintered compact w1. Upon such extrusion of compressed sintered compact $W_1$, forging is made on compressed sintered compact $W_1$ maintaining the minute texture of whole compressed sintered compact $W_1$. This forms a forging $W_2$ having a high quality without producing defects such as crack and the like. Forging $W_2$ is taken out from die 5 upon opening die 5 after the forging.

During the step of forging, it is not carried out to extrude whole compressed sintered compact $W_1$ into small diameter section 9 of the inner surface of die 5 so that a part (corresponding to a certain thickness or height) of the forging located at the large diameter section 8 remains not-extruded. Accordingly, the thus obtained forging $W_2$ is provided with the tapered section and the large diameter section which are formed on the upper end of the small diameter section of the forging.

Here, a variety of experiments were conducted in connection with the forging method according to the present invention.

Figure 3:
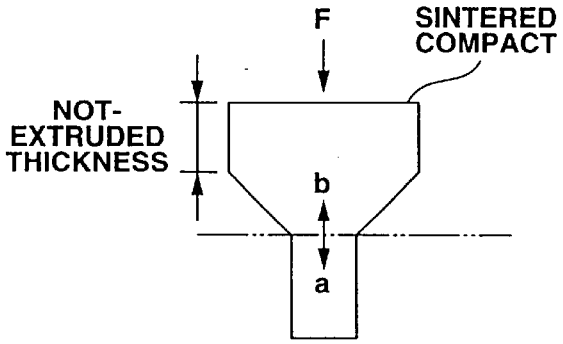
FIG. 3 is a schematic side view showing the shape of a forging in experiment carried out to obtain experimental data of FIGS. 4 and 5.
Figure 4:
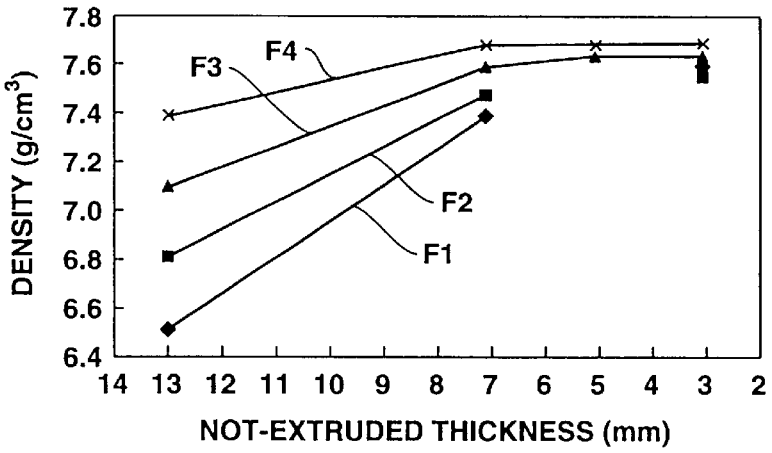
FIG. 4 is a graph representing the experimental data showing the relationship between the not-extruded thickness and the density of the forging of FIG. 3.
Figure 5:
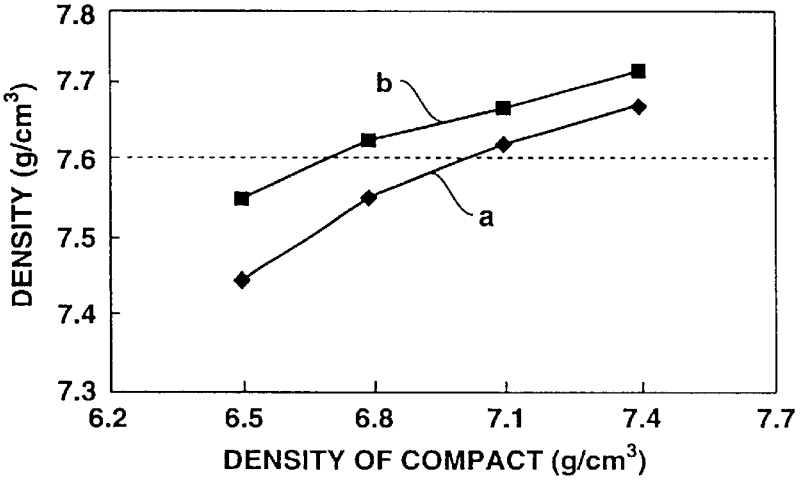
FIG. 5 is a graph representing the experimental data showing the relationship between the density of the compact and the density of the forging of FIG. 3.

First, experiments for obtaining data shown in FIGS. 4 and 5 were conducted in accordance with the following forging method: Compacting was made on four kinds of metallic powders whose main component was iron containing 0.5% by weight of graphite so as to obtain four kinds of compacts which had respectively densities of 6.5 g/cm$^3$, 6.8 g/cm$^3$, 7.1 g/cm$^3$ and 7.4 g/cm$^3$. The four kinds of compacts were subjected to sintering at the above sintering temperature range of 700 to 1000° C. thereby obtaining four kinds of sintered compacts. Each of the sintered compacts was filled in the die of a forging machine similar to that shown in FIG. 1, and then underwent a forward (downward) extrusion under pressure from one direction, in which the reduction in area of each sintered compact was 60%, thereby obtaining an extruded sintered compact. The forward extrusion was an extrusion of each sintered compact in a direction of an arrow F in FIG. 3 which showed each sintered compact which had underwent the forward extrusion. In the experiments, the densities of the extruded sintered compacts were measured upon varying a not-extruded thickness (See FIG. 3) which meant a thickness (axial dimension) of a part remaining not-extruded thereby obtaining data shown in FIG. 4. In FIG. 4, a line F1 indicates the data of the compact which had the density of 6.5 g/cm$^3$ and was subjected to the forward extrusion. A line F2 indicates the data of the compact which had the density of 6.8 g/cm$^3$ and was subjected to the forward extrusion. A line F3 indicates the data of the compact which had the density of 7.1 g/cm$^3$ and was subjected to the forward extrusion. A line F4 indicates the data of the compact which had the density of 7.4 g/cm$^3$ and was subjected to the forward extrusion.

As apparent from FIG. 4, the density of the compact largely affects extrusion of the sintered compact. When the density of the compact was 6.5 g/cm$^3$ or 6.8 g/cm$^3$, it was not possible to complete the extrusion to obtain a desired not-extruded thickness so that the density of a resultant forging could not exceed the value of 7.6 g/cm$^3$ which was a standard value for practical use. In contrast, when the density of the compact was 7.1 g/cm$^3$ or 7.4 g/cm$^3$, a resultant forging having the density exceeding 7.6 g/cm$^3$ was obtained.

Additionally, experiments were conducted in such a manner that the forward extrusion was made on each of the sintered compacts whose compacts had respectively the densities of 6.5 g/cm$^3$, 6.8 g/cm$^3$, 7.1 g/cm$^3$ and 7.4 g/cm$^3$. In these experiments, the densities of a lower part a (at the side of the small diameter section) shown in FIG. 3 and an upper part b (at the side of the tapered section and the large diameter section) shown in FIG. 3 were measured upon making the forward extrusion on each of the sintered compacts. The data of this measurement were shown in FIG. 5 in which a line a indicates the data of the lower part a of the extruded sintered compact; and a line b indicates the data of the upper part b of the extruded sintered compact. As apparent from FIG. 5, in case that the densities of the compacts were as high as 7.1 g/cm$^3$ and 7.4 g/cm$^3$, the densities of both the lower part a and the upper part b take sufficient values exceeding 7.6 g/cm$^3$, and the difference between the densities of the lower and upper part a, b was made small. Accordingly, dispersion in densities of various parts in the resultant forging can be suppressed lower.

Figures 6A, 6B:
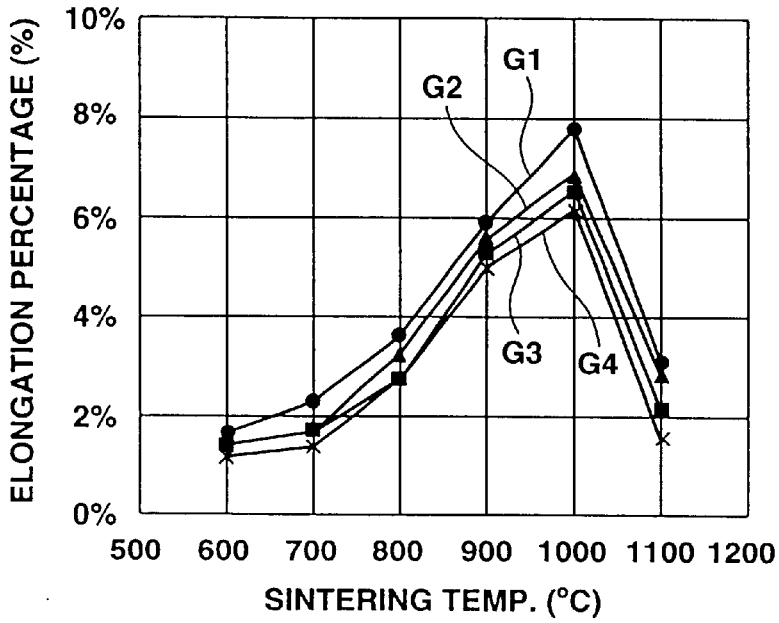
FIG. 6A is a table containing experimental data representing the relationship between the sintering temperature and the elongation percentage of the sintered compact in terms of the amount of graphite mixed with a metal powder (alloy steel powder) same as that in Example 1.
FIG. 6B is a graph showing the experimental data of FIG. 6A.

FIGS. 6A and 6B respectively show experimental data and graphs obtained under experiments in which forgings or products were produced similarly to Example 1 which will be discussed after and by varying the amount of graphite to be mixed with the alloy steel powder (containing 1.0% by weight of chromium, 0.3% by weight of molybdenum, 0.7% by weight of manganese and balance consisting of iron and unavoidable impurities) in Example 1. The amount of the graphite was varied as 0.1% by weight, 0.3% by weight, 0.5% by weight and 1.0% by weight which were respectively indicated as 0.1%C, 0.3%C, 0.5%C, 1.0%C in FIG. 6A. The data and the graphs represent the relationship between the sintering temperature and the elongation percentage of the sintered compact. In FIG. 6B, lines G1, G2, G3 and G4 indicate respectively the data of the sintered compacts of the above graphite amounts of 0.1% by weight, 0.3% by weight, 0.5% by weight and 1.0% by weight.

Figures 7A, 7B:
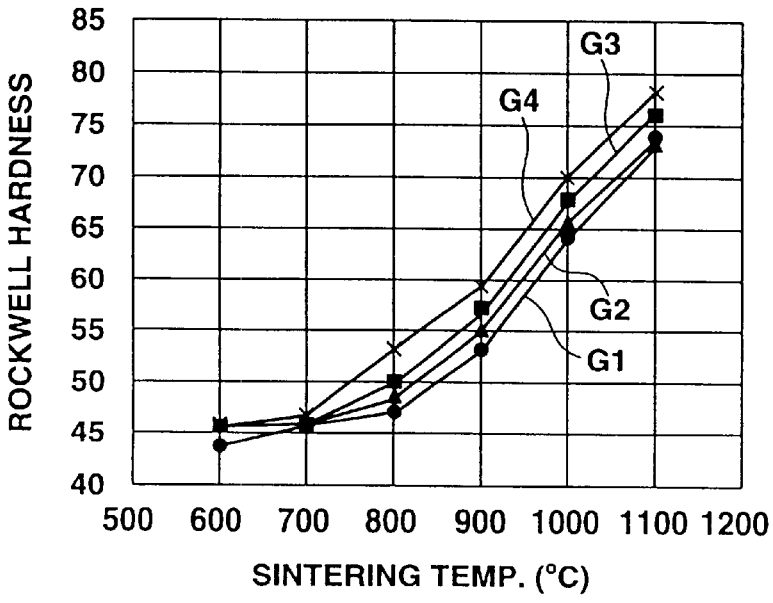
FIG. 7A is a table containing experimental data representing the relationship between the sintered temperature and the hardness of the sintered compact in terms of the amount of graphite mixed with the metal powder (alloy steel powder) same as that in Example 1.
FIG. 7B is a graph showing the experimental data of FIG. 7A.

FIGS. 7A and 7B respectively show experimental data and graphs obtained under experiments in which forgings or products were produced similarly to Example 1 and by varying the amount of graphite to be mixed with the alloy steel powder in Example 1. The amount of the graphite was varied as 0.1% by weight, 0.3% by weight, 0.5% by weight and 1.0% by weight which were respectively indicated as 0.1%C, 0.3%C, 0.5%C, 1.0%C in FIG. 7A. The data and the graphs represent the relationship between the sintering temperature and the Rockwell hardness of the sintered compact. In FIG. 7B, lines G1, G2, G3 and G4 indicate respectively the data of the sintered compacts of the above graphite amounts of 0.1% by weight, 0.3% by weight, 0.5% by weight and 1.0% by weight.

As apparent from the data and graphs of FIGS. 6A to 7B, in case that the sintering temperature is selected within the range of 700 to 1000° C., binding among metals progresses thereby providing a sintered compact elongation percentage for rendering forging possible. Even if the sintering temperature is 1000° C. at which the hardness becomes the highest, the hardness can be maintained at a value slightly higher than a Rockwell hardness (B-scale) of 60 by adjusting the amount of graphite to be mixed with the alloy steel powder. The value of Rockwell hardness (B-scale) of 60 is generally the same as that obtained by making annealing on a high strength cold forged steel; however, the above-mentioned sintered compact in connection with FIGS. 7A and 7B can obtain the value close to the Rockwell hardness (B-scale) of 60 without annealing.

Figures 8A, 8B:
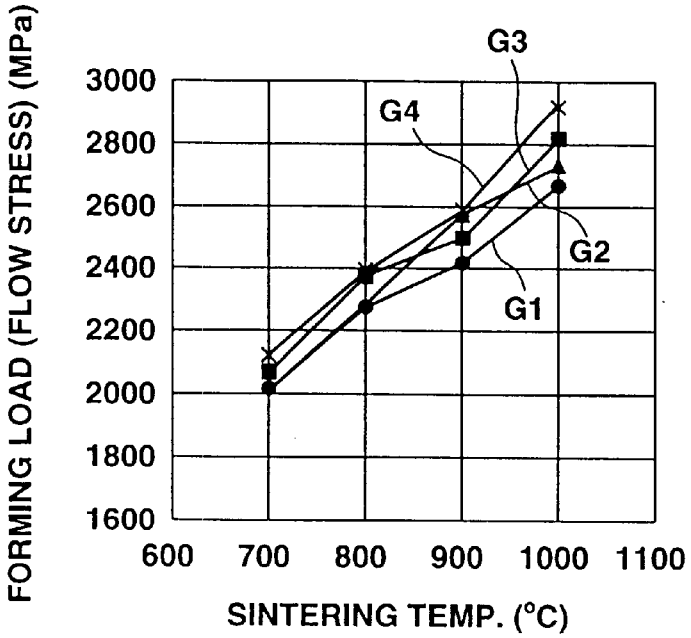
FIG. 8A is a table containing experimental data representing the relationship between the sintered temperature and the forming load (flow stress) of the sintered compact in terms of the amount of graphite mixed with the metal powder (allow steel powder) same as that in Example 1.
FIG. 8B is a graph showing the experimental data of FIG. 7A.

The above-mentioned sintered compact which has been sintered at the temperature ranging from 700 to 1000° C. is filled in the forging die and subjected to the compression and the extrusion forging which are accomplished successively. During the compression and the extrusion forging, voids in the metallic texture of the sintered compact are squeezed thereby accomplishing densification of the metallic texture and forming of the sintered compact. At this time, sufficient graphite remains at the grain boundary of metal powder in the sintered compact, and therefore a forming load (flow stress or deformation resistance) MPa can be made very low as depicted in FIGS. 8A and 8B. In other words, in the above-mentioned sintered compact, diffusion of carbon is hardly made and therefore the sintered compact is low in hardness and high in elongation percentage. Additionally, graphite existing at metallic grain boundary functions to promote slip among particles of the metal powder, and therefore the forming load during the compression and the extrusion becomes small thus making it possible to easily form the forging into a desired shape. FIGS. 8A and 8B show experimental data and graphs obtained under experiments in which forgings or products were produced similarly to Example 1 and by varying the amount of graphite to be mixed with the alloy steel powder in Example 1. The amount of the graphite was varied as 0.1% by weight, 0.3% by weight, 0.5% by weight and 1.0% by weight which were respectively indicated as 0.1%C, 0.3%C, 0.5%C, 1.0%C in FIG. 8A. The data and the graphs represent the relationship between the sintering temperature and the forming load (flow stress or deformation resistance) MPa applied for the compression and the extrusion of the sintered compact. In FIG. 8B, lines G1, G2, G3 and G4 indicate respectively the data of the sintered compacts of the above graphite amounts of 0.1% by weight, 0.3% by weight, 0.5% by weight and 1.0% by weight.

In the forging method according to the present invention, the compression and the extrusion forging of the sintered compact are successively accomplished using the forging die. As a result, the material or sintered compact cannot make its work hardening after the compression step, and therefore there arises no problem even in case of using a material which tends to readily make its work hardening. Additionally, in this forging method, the compression and the extrusion of the sintered compact are carried out under a not-heated condition, thereby making it unnecessary that the forging die is provided with an apparatus for heating the die. This makes the forging machine small-sized and simplified while preventing the dimensional accuracy of the resultant forging from lowering due to heating. Further, not-heating the forging die prevents the forging die from its thermal deterioration thereby prolong the durability of the forging die.

FIG. 10 shows experimental data for the purpose of comparison in dimensional accuracy of a resultant forging between a conventional forging method and the forging method according to the present invention. The resultant forging was generally cup-shaped.

Figure 11:
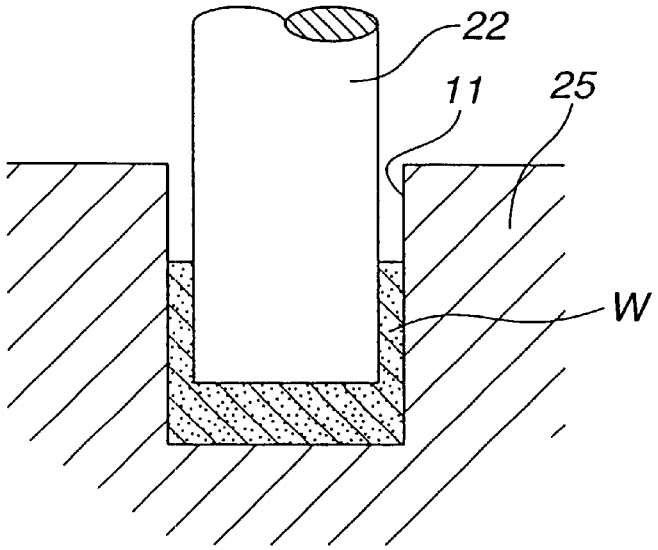
FIG. 11 is a vertical sectional view showing the conventional forging method used for obtaining the experimental data of FIG. 10.

The conventional forging (hot forging) method was accomplished as follows: As shown in FIG. 11, a sintered compact W was filled in a forming hole 11 formed in a die 25. At this state, a punch 22 is moved downward to press the central part of the sintered compact W thereby to forge a generally cup-shaped forging.

Figure 12:
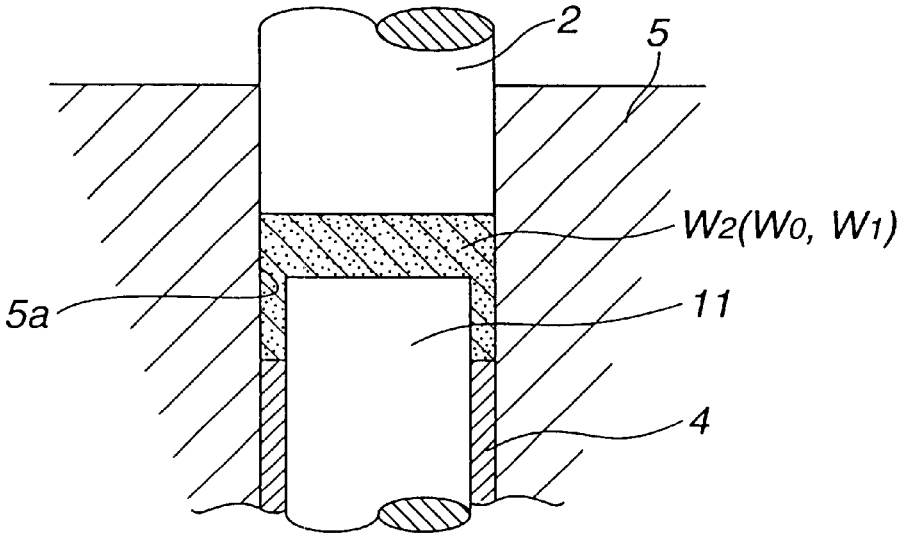
FIG. 12 is fragmentary sectional view showing the forging method according to the present invention used for obtaining the experimental data of FIG. 10.

In contrast, in the forging method according to the present invention accomplished using a forging machine similar to that shown in FIG. 1 with the exception that the inner peripheral surface of die 5 was cylindrical, as shown in FIG. 12, a core 11 was projected upward from a downward direction in a forming hole or space 5*a* of the die 5. At this state, the sintered compact $W_0$ is filled in the forming hole 12. Then, lower punch 4 was moved upward while upper punch 2 is moved downward so as to press the sintered compact $W_0$. Thereafter, the pressing force of lower punch 4 was reduced thereby to forge a generally cup-shaped forging. This forging method was similar in forming and forging the sintered compact to those in Example 1 (discussed after) with the exception that the generally cup-shaped forging was formed in place of the pinion shaft.

As depicted in the experimental data shown in FIG. 10, in case of the above conventional hot forging method, dispersion of the outer diameter and the inner diameter of the resultant cup-shaped forging are 1.0 mm. In contrast, in case of the forging method according to the present invention, dispersions of the outer diameter and the inner diameter of the resultant cup-shaped forging are respectively 0.03 mm and 0.06 mm. These experimental data reveal that a dimensional error due to thermal shrinkage is very low in the forging method according to the present invention in which no heat is applied. Additionally, in the forging method according to the present invention, the forging can be easily taken out from the die without forming a draft in the die. Furthermore, according to the forging method of the present invention, the sintered compact is formed under the forward extrusion while being pressed from two directions, thereby making it possible to realize the extrusion forging of a long member or sintered compact which has conventionally been difficult to be forged.

EXAMPLES

The present invention will be more readily understood with reference to the following Examples in comparison with Comparative Example; however, these Examples are intended to illustrate the invention and are not to be construed to limit the scope of the invention.

Example 1

Graphite in an amount of 0.3% by weight was mixed with alloy steel powder containing 1.0% by weight of chromium (Cr), 0.3% by weight of molybdenum (Mo), 0.7% by weight of manganese (Mn) and balance consisting of iron (Fe) and unavoidable impurities, thereby forming metallic powder as raw material. This metallic powder was compacted thereby forming a compact having a density of 7.4 g/cm$^3$. This compact was sintered in the atmosphere of nitrogen in a furnace at 800° C. (sintering temperature) for 60 minutes thereby producing a sintered compact. The thus produced sintered compact had an elongation percentage of 3.3% and a Rockwell hardness (B-scale) of 48.6.

Subsequently, the sintered compact was filled in the die of the forging machine shown in FIG. 1 and subjected to the compression and the extrusion forging in the manner of two-direction pressing under conditions in which the load of upper punch 2 was 46 tonf; the forming or moving speed of upper ram 1 was 5 mm/sec.; the load of lower punch 4 was 15 tonf; the stopping time of the both punches during the compression was 1 second; the reduction in area of the sintered compact was 30%. As a result, a forging or pinion shaft was produced; and the forming load (flow stress) was 2333 MPa. The thus produced forging had no crack and high in quality as shown in FIG. 9 in which the composition "1.0Cr-0.3Mo-0.7Mn" indicates the composition of the alloy steel powder containing 1.0% by weight of chromium (Cr), 0.3% by weight of molybdenum (Mo), 0.7% by weight of manganese (Mn) and balance consisting of iron (Fe) and unavoidable impurities.

For the purpose of comparison, the sintered compact filled in the die was subjected to the forward extrusion in the direction of the arrow F in FIG. 3, thereby forming a forging. Additionally, the sintered compact filled in the die was subjected to a rearward extrusion which was an extrusion of the sintered compact in the opposite direction relative to the direction of the arrow F in FIG. 3, thereby forming a forging. As a result, in case of the forward extrusion, apparent crack was produced in the extruded sintered compact so that the forgeability is evaluated as no good (NG). In case of the rearward extrusion, no apparent crack was produced in the extruded sintered compact, and therefore the extruded sintered compact seemed to be evaluated good (G) as shown in FIG. 9; however, the forging obtained under the two-direction pressing was largely high in quality as compared with that obtained under the rearward extrusion.

Comparative Example

The procedure of producing the sintered compact in Example 1 was repeated with the following exceptions: Graphite in an amount of 0.5% by weight was mixed with the alloy steel powder thereby forming metallic powder; the metallic powder was compacted thereby forming a compact having a density of 7.1 g/cm$^3$; and the compact was sintered in the atmosphere of nitrogen gas in a furnace at 1250° C. for 60 minutes thereby producing a sintered compact. The thus produced sintered compact had a relatively low elongation percentage of 2.6% and a relatively high Rockwell hardness (B-scale) of 75.0.

The sintered compact was subjected to the forging in the manner of the two-direction pressing, the forward extrusion and the rearward extrusion were made similarly to those in Example so as to intend to form forgings. As a result of the above low elongation percentage and high hardness of the sintered compact, it is impossible to accomplish forging not only under the forward extrusion and the rearward extrusion but also under the two-direction pressing, and therefore the forgeability was evaluated no good (NG) as shown in FIG. 9.

Example 2

The procedure of producing the sintered compact in Example 1 was repeated with the following exceptions: The metallic powder was compacted at a compacting load of 2596 MPa thereby forming a compact; the compact was sintered in the atmosphere of nitrogen gas in a furnace at 900° C. for 60 minutes thereby producing a sintered compact. The thus produced sintered compact had an elongation percentage of 5.7% and a Rockwell hardness (B-scale) of 55.1.

Subsequently, the sintered compact was filled in the die of the forging machine shown in FIG. 1 and subjected to the compression and the extrusion forging in the manner of two-direction pressing under the same conditions as those in Example 1 with the exception that the forming load (flow stress) was 2596 MPa. As a result, a forging or pinion shaft was produced. The thus produced forging had no crack and high in quality as shown in FIG. 9.

Additionally, the sintered compact was subjected to the forging in the manner of the forward extrusion and the rearward extrusion similarly to those in Example 1, so as to intend to form forgings. FIG. 9 depicts that the forgeability of the sintered compact was evaluated good (G) in case of the two-direction pressing, similarly to that in Example 1

As appreciated from the above, according to the forging method of the present invention, the forging having no defects such as crack and the like can be produced under a cold forging. This makes it unnecessary to provide the forming machine or facility with a heating device, thereby small-sizing and simplifying the forging machine thus lowering a production cost of the forging. Additionally, the dimensional accuracy of the forging can be raised. Furthermore, deterioration of the die due to heat can be prevented. In case that the compressing step and the extruding step are successively carried out by using the forging die or the like having the compression section continuous with the extrusion section, forging can be easily accomplished even on a raw material which tends to readily make its work hardening. Additionally, since the sintered compact may be extruded under the forward extrusion in the extruding step, forging can be easily made on a long member which has been difficult to be forged.

The entire contents of Japanese Patent Application No. 2000-330105, filed Oct. 30, 2000, is incorporated herein by reference.

What is claimed is:

1. A method of forging a raw material for sintering and forging, comprising the steps of:

compacting metallic powder containing iron as a main component and graphite to obtain a compact having a predetermined density;

sintering the compact at a temperature ranging from 700 to 1000° C. to form a sintered compact having a texture in which graphite is retained at grain boundary of metal powder;

compressing the sintered compact from two directions to obtain a compressed sintered compact; and extruding the compressed sintered compact by pressing the compressed sintered compact from the two directions in a manner that a pressure in one of the two directions is reduced relative to a pressure in the other of the two directions to accomplish extrusion forging.

2. A method as claimed in claim 1, wherein the metallic powder contains at least one selected from the group consisting of chromium, molybdenum, manganese, nickel, copper, tungsten, vanadium and cobalt.

3. A method as claimed in claim 1, wherein the predetermined density of the compact is not lower than 7.1 g/cm$^3$.

4. A method as claimed in claim 1, wherein the compressing step and the extruding step are successively carried out without any intervening steps therebetween.

5. A method as claimed in claim 1, wherein the compressing step and the extruding step are carried out without heating the sintered compact.

6. A method as claimed in claim 1, wherein the compressed sintered compact is extruded under a forward extrusion in the extruding step.

7. A method as claimed in claim 1, further comprising the step of preparing a die which has a compression section formed with a first space in which the sintered compact is set to be compressed, and an extrusion section continuous with the compression section and formed with a second space continuous with the first space of the compression section, the second space being smaller in sectional area than the first space, wherein the compression step is carried out by the compression section to increase a density of the sintered compact to form a compressed sintered compact which is to be extruded into the extrusion section, and the extruding step is carried out by the extrusion section successively to the compression step to form a forging.

8. A method as claimed in claim 7, wherein the first space of the compression section of the die is shaped corresponding to a final product.

9. A method as claimed in claim 1, wherein the two directions are opposite directions.

10. A method of forging a raw material for sintering and forging, comprising the steps of:

compacting metallic powder containing iron as a main component and graphite to obtain a compact;

sintering the compact at a temperature ranging from 700 to 1000° C. to form a sintered compact having a texture in which graphite is retained at grain boundary of metal powder;

filling the compact in a forming space of a die;

compressing the sintered compact in the forming space of the die from opposite directions without heating to obtain a compressed sintered compact; and extruding the compressed sintered compact in the die without heating by controlling pressures in the opposite directions in a manner that the pressure in one of the opposite directions is decreased relative to the pressure in the other of the opposite directions to accomplish extrusion forging.

11. A method as claimed in claim 1, wherein the extruding step is carried out without heating the compressed sintered compact.

12. A method as claimed in claim 1, wherein the predetermined density of the compact is not lower than 7.3 g/cm$^3$.

13. A method as claimed in claim 1, wherein the compressing step is carried out without heating the sintered compact.

14. A method as claimed in claim 1, wherein the extruding step is performed before the compressed sintered compact becomes work hardened.

15. A method as claimed in claim 1, further comprising the step of preparing a die which has a compression section formed with a first space in which the sintered compact is set to be compressed, and an extrusion section continuous with the compression section and formed with a second space continuous with the first space of the compression section.

16. A method as claimed in claim 15, wherein the extruding step being carried out on a first part of the sintered compact in the extrusion section, and without being carried out on a second part of the sintered compact remaining in the compression section, where the second part has a shape of a final product.

17. A method as claimed in claim 15, wherein the compressing step and the extruding step are successively carried out without removing the sintered compact from the die therebetween.

18. A method as claimed in claim 17, wherein the second space is smaller in sectional area than the first space.

19. A method of forging a raw material for sintering and forging, comprising the steps of:

compacting metallic powder containing iron as a main component and graphite to obtain a compact having a density which is not lower than 7.1 g/cm$^3$;

sintering the compact at a temperature ranging from 700 to 1000° C. to form a sintered compact having a texture in which graphite is retained at grain boundary of metal powder;

compressing the sintered compact from two directions to obtain a compressed sintered compact having a density which is not lower than 7.3 g/cm$^3$; and extruding the compressed sintered compact by pressing the compressed sintered compact from the two directions in a manner that a pressure in one of the two directions is reduced relative to a pressure in the other of the two directions to accomplish extrusion forging.

20. A method as claimed in claim 19, wherein the density of the compact is not lower than 7.3 g/cm$^3$; and the density of the compressed sintered compact is not lower than 7.6 g/cm$^3$.

* * * * *